US008793944B2

(12) United States Patent
Blomberg et al.

(10) Patent No.: US 8,793,944 B2
(45) Date of Patent: Aug. 5, 2014

(54) RAIL MOUNTING SYSTEM FOR MOUNTING SKYLIGHTS AND THE LIKE DIRECTLY TO RIB ELEVATIONS OF A RAISED RIB METAL PANEL ROOFING SYSTEM

(71) Applicant: ABL IP Holding, LLC, Conyers, GA (US)

(72) Inventors: Jerome O. Blomberg, Las Vegas, NV (US); Scott Weaver, Rancho Cordova, CA (US)

(73) Assignee: ABL IP Holding, LLC, Conyers, GA (US)

( * ) Notice: Subject to any disclaimer, the term of this patent is extended or adjusted under 35 U.S.C. 154(b) by 0 days.

(21) Appl. No.: 13/647,565

(22) Filed: Oct. 9, 2012

(65) Prior Publication Data

US 2013/0031855 A1 Feb. 7, 2013

Related U.S. Application Data

(63) Continuation of application No. 12/572,176, filed on Oct. 1, 2009, now abandoned.

(60) Provisional application No. 61/102,333, filed on Oct. 2, 2008.

(51) Int. Cl.
*E04D 13/03* (2006.01)

(52) U.S. Cl.
USPC ..... 52/200

(58) Field of Classification Search
USPC ..... 52/200
See application file for complete search history.

(56) References Cited

U.S. PATENT DOCUMENTS 3,521,414 A * 7/1970 Malissa ..... 52/107
3,791,088 A 2/1974 Sandow et al.

(Continued)

FOREIGN PATENT DOCUMENTS

GB 981948 2/1965
JP 2000-336859 12/2000

(Continued)

OTHER PUBLICATIONS

Photographs, strip skylight installation at FAA facility, Sacramento, CA, sold by Washoe Equipment, Inc. dba Sunoptics Prismatic Skylights, having a principal office in Sacramento, CA; sale made prior to 2007.

(Continued)

*Primary Examiner* — Andrew J Triggs
(74) *Attorney, Agent, or Firm* — Beeson Skinner Beverly, LLP

(57) ABSTRACT

A rail mounting system is provided for mounting skylights and other structures directly to rib elevations of a metal panel roofing system. The rail mounting system has a side rail for each side of a skylight or run of skylights that mount to the metal panel roof's rib elevations. Each side rail includes a vertical riser wall, an upper flange extending from the riser wall to provide a top bearing surface for one side of a skylight or run of skylights, and a bottom shoulder structure extending from the riser portion which is adapted for attachment to a rib elevation of the roofing system. The rib elevations on which the side rails of the rail mounting system are attached provide structural support for the skylight or run of skylights supported thereon for substantially the entire length of the skylights or run of skylights.

9 Claims, 18 Drawing Sheets

(56) References Cited

U.S. PATENT DOCUMENTS

| | | | | |
|---|---|---|---|---|
| 3,828,494 | A | 8/1974 | Uhrhane et al. | |
| 3,967,423 | A | 7/1976 | Hammond | |
| 4,117,638 | A | 10/1978 | Kidd, Jr. et al. | |
| 4,155,206 | A | 5/1979 | Player | |
| 4,296,581 | A | 10/1981 | Heckelsberg | |
| 4,470,230 | A | 9/1984 | Weisner | |
| 4,520,604 | A | 6/1985 | Halsey et al. | |
| 4,559,753 | A | 12/1985 | Brueske | |
| 4,621,466 | A | 11/1986 | Sonneborn et al. | |
| 4,649,680 | A | 3/1987 | Weisner et al. | |
| 4,703,596 | A | 11/1987 | Sandow | |
| 4,730,426 | A | 3/1988 | Weisner et al. | |
| 4,776,141 | A | 10/1988 | Powell | |
| 4,825,608 | A | 5/1989 | Makin | |
| 4,848,051 | A | 7/1989 | Weisner et al. | |
| 4,860,511 | A | 8/1989 | Weisner et al. | |
| 4,986,039 | A | 1/1991 | Weisner | |
| 5,027,576 | A | 7/1991 | Gustavsson | |
| 5,323,576 | A * | 6/1994 | Gumpert et al. | 52/200 |
| 5,511,354 | A | 4/1996 | Eidson | |
| 5,522,189 | A * | 6/1996 | Mortensen et al. | 52/200 |
| 5,896,711 | A * | 4/1999 | McClure | 52/200 |
| 6,079,167 | A | 6/2000 | Voegele, Jr. | |
| 6,151,838 | A | 11/2000 | Husein | |
| 6,640,508 | B2 | 11/2003 | Lindgren et al. | |
| 6,966,157 | B1 | 11/2005 | Sandow | |
| 7,043,882 | B2 | 5/2006 | Gumpert et al. | |
| 7,059,086 | B2 * | 6/2006 | Edvardsen | 52/58 |
| 7,296,388 | B2 | 11/2007 | Valentz et al. | |
| 7,308,777 | B2 | 12/2007 | Sandow | |
| 7,395,636 | B2 | 7/2008 | Blomberg | |
| 7,712,279 | B2 * | 5/2010 | McClure | 52/580 |
| 7,721,493 | B2 | 5/2010 | Skov et al. | |
| 7,736,014 | B2 | 6/2010 | Blomberg | |
| 2007/0094984 | A1 | 5/2007 | McClure | |
| 2007/0101665 | A1 * | 5/2007 | Sandow | 52/200 |
| 2008/0040993 | A1 | 2/2008 | Valentz et al. | |
| 2008/0190050 | A1 | 8/2008 | McClure | |
| 2010/0162643 | A1 | 7/2010 | Blomberg et al. | |

FOREIGN PATENT DOCUMENTS

| | | |
|---|---|---|
| JP | 2001-214577 | 8/2001 |
| JP | 2008-202372 | 9/2008 |
| WO | WO2010040006 | 4/2010 |

OTHER PUBLICATIONS

Photographs, strip skylight installation at a Siemens building sold by Washoe Equipment, Inc. dba Sunoptics Prismatic Skylights, having a principal office in Sacramento, CA; sale made prior to 2007.

* cited by examiner

RAIL MOUNTING SYSTEM FOR MOUNTING SKYLIGHTS AND THE LIKE DIRECTLY TO RIB ELEVATIONS OF A RAISED RIB METAL PANEL ROOFING SYSTEM

CROSS-REFERENCE TO RELATED APPLICATIONS

This is a continuation of application Ser. No. 12/572,176 filed Oct. 1, 2009, now pending, which claims the benefit of U.S. Provisional Patent Application No. 61/102,333, filed Oct. 2, 2008. Both of the above-mentioned applications are incorporated herein by reference in their entirety, and made a part hereof.

BACKGROUND OF THE INVENTION

1. Field of the Invention

The present invention generally relates to roof penetrating systems such as skylights, and more particularly relates to skylight and similar systems which are installed on metal panel roofs having rib elevations.

2. Description of Related Art

Various systems involving curb structures have heretofore been used for inserting skylights and smoke vents into metal panel roofs. The most commonly used skylighting systems are those which incorporate translucent or transparent layers held in a framework that penetrates the roof structure, so as to allow ambient daylight into the building.

In the past roof penetrating installations have required a complex structure beneath the roofing panels in order to support a roof curb to which the skylight was attached. Skylight curbs are generally in the form of a preassembled box structure fixed within a roof cutout or opening. However, the retrofitting of such curb systems into existing roof structures is problematic.

U.S. Pat. No. 4,296,581, to Heckelsberg, issued Oct. 27, 1981, provides an example of a roofing structure of the type which is constructed of a series of metal panels having flanges that interlock when the panels are laid side by side and which are subsequently tightly seamed together to convert the individual panels into an integrated roof-forming membrane. This roof structure is mounted to the purlins in the roof with clips that permit the panels to expand or contract in response to temperature and pressure changes, thereby minimizing roof stressing.

U.S. Pat. No. 4,703,596, to Sandow, issued Nov. 3, 1987, and titled "Grid Skylight System," provides a grid skylight support apparatus that includes prefabricated grid row frames, each of which form of a number of connected beam supports which define a number of bays. Each bay has a skylight curb formed by the upper flanges of the beam supports to receive a preassembled skylight unit. The sides of each grid row frame provide a mating edge that can register with the mating edge of an adjacent grid row frame during assembly. The skylights have peripheral support skirts that register upon each bay and a light-transmitting skylight panel to cover the peripheral support. Cross gutters on each grid row frame, which are positioned between adjacent skylights, extend at an angle toward the mating edge of the grid row frame for carrying rainwater to a main gutter channel formed by field-assembly of the mating edges of two adjacent grid row frames. The main gutter channel includes a pair of longitudinally extending gutter sections, each of which have a main gutter channel surface with a lower elevation than the elevation of the cross flow channel. Fasteners assemble the grid row frame mating edges together in a continuous seal to prevent rainwater leakage at the mating edges of adjacent grid row frames.

U.S. Pat. No. 4,520,604, to Halsey, et al., issued Jun. 4, 1985, and titled "Skylight Structure," teaches a curb structure that is dimensioned to be passed through an opening in a roof and then attached in moisture impervious relation to the roof from within a building interior. A skylight assembly including a frame and light transmitting member secured to the frame is dimensioned to be passed through the opening and attached in a sealing engagement to the curb structure from within the building interior for covering the opening. The skylight assembly is then secured to the rafters and headers at an interior location. The frame includes upper and lower clamping jaws and spaced fulcrum links attached to the jaws for clamping the light transmitting member thereto. The lower clamping jaw includes a channel which engages and is interlocked with the curb structure.

Other skylight systems, as contemplated in U.S. Pat. No. 4,470,230, by Weinser, provide a prefabricated skylight support curb that is formed to be a protective packaging for the skylight during shipment and then used as a curb for mounting the skylight on a roof. A prefabricated skylight support curb for supporting a skylight thereover has a bottom flange, angled upright sides, and a top lip around the top of the sides which form an opening through the curb. A skylight is adapted to cover the opening formed by the skylight support curb when the skylight is installed, and has a domed portion, an angled curb portion extending from the dome portion and a drip edge on the curb portion. The skylight curb portion is shaped to fit over a portion of the prefabricated skylight support curb. The skylight and skylight support curb are shaped so that they can nest together in stacks of skylights and curbs to protect the skylights during shipping and storing.

In another skylight system, as contemplated in U.S. Pat. No. 3,791,088, by Sandow, et al., a prefabricated multiple dome unit or skylights and composite is provided, wherein each multiple dome unit has several domes of transparent or translucent material mounted together on a common frame, and wherein means are provided for assembling a plurality of such dome units into a composite thereof on a building, with the units lapped and inter-fitted so as to provide a continuous drainage system discharging to the exterior of the units in the composite assembly.

In yet another skylight system, as contemplated in U.S. Pat. No. 4,642,466, by Sanneborn, et al., a flashing frame is described for roof windows to be installed adjacent to each other with edges facing each other in the installed position with a connecting flange of its upper flashing members extending beneath the roofing and, if need be, with its lower flashing members and required intermediary flashing members, obliquely outwardly bent connecting webs and each with a connecting bar with supporting webs which rearwardly engage the connecting webs being adjacent to the width of the installation distance and are obliquely bent inwardly on both sides, and at least one inner projection which engages between the facing corner edges of the connecting webs in the installed position, thus maintaining these corner edges at the installation distance.

In today's world of mandated energy efficiency in all types of buildings the metal building industry needs a more economical and less detrimental way to use skylights and smoke vents to daylight their buildings. To ensure adequate daylighting, however, typical skylight and smoke vent installations require multiple roof penetrations that cut through and remove plural major elevations in standing seam and other raised rib metal panel roof profiles. These curbs create multiple opportunities for water to enter the interior of the building, due to multiple curb locations and the width of the curbs, as well as the challenge to effectively seal the roof at the high end of such curbs.

The traditional curb constructions and methods of attachment in most cases require a complicated support structure to be installed below the roof panel, which can restrict movement associated with the thermal expansion and contraction of the metal roof due to temperature changes and the like.

None of the prior approaches have been able to provide an installation system for multiple skylights that accomplishes all the goals of economy and simplicity of installation and that will work equally well for new buildings and as a retrofit in existing buildings.

SUMMARY OF THE INVENTION

The invention provides a rail mounting system for installing two or more adjacent skylights and or similar roof penetrating structures, such as smoke vents, end to end onto a building's raised rib metal panel roofing system. The invention can be adapted to different metal panel roofing systems, including a standing seam, snap seam, and "R" panel roof types, and can be mounted so that the system can move with the expansion and contraction of the roof.

In accordance with the invention, a rail mounting system comprises a side rail for supporting each side of a unit skylight or a run of unit skylights (or similar structures, such as smoke vents, mounted over a roof penetration). The side rails are mounted directly to the rib elevations, and preferably adjacent rib elevations, of the metal panel roof and take advantage of the inherent structural integrity of the rib elevations to support the weight of the skylight unit or units. Each side rail is comprised of a vertical riser portion having a top and a bottom, an upper flange for providing a top bearing surface for supporting a skylight unit, and a bottom shoulder structure adapted for attachment to a rib elevation of a metal raised rib panel roofing system. The metal roof rib elevations to which the side rails are attached provide structural support for the unit skylight or run of unit skylights for substantially the entire length of the unit skylights or run of unit skylights.

The invention is also directed to a raised rib panel roofing system having a skylight or other structure requiring a roof penetration. The roofing system is comprised of roof eaves, a roof ridge, and, roofing panels extending from the roof eaves to the roof ridge. The roofing panels form a roof having parallel rib elevations extending from the roof eaves to the roof ridge and panel flats between the rib elevations. A roof penetration is provided in the panel flat of the roof between two rib elevations, and side rails are mounted directly to the rib elevations adjacent the roof penetration such that the rib elevations provide structural support for the side rails. A skylight or other structure is mounted to the side rails and extended over the roof penetration.

These and other features and advantages of this invention are described in, or are apparent from, the following detailed description of various exemplary embodiments of the apparatus and methods according to this invention.

BRIEF DESCRIPTION OF THE DRAWINGS

A more complete understanding of the present invention and the attendant features and advantages thereof may be had by reference to the following detailed description when considered in conjunction with the accompanying drawings wherein various figures depict the components and composition of the multiple skylight system.

DETAILED DESCRIPTION OF THE INVENTION

Figure 1:
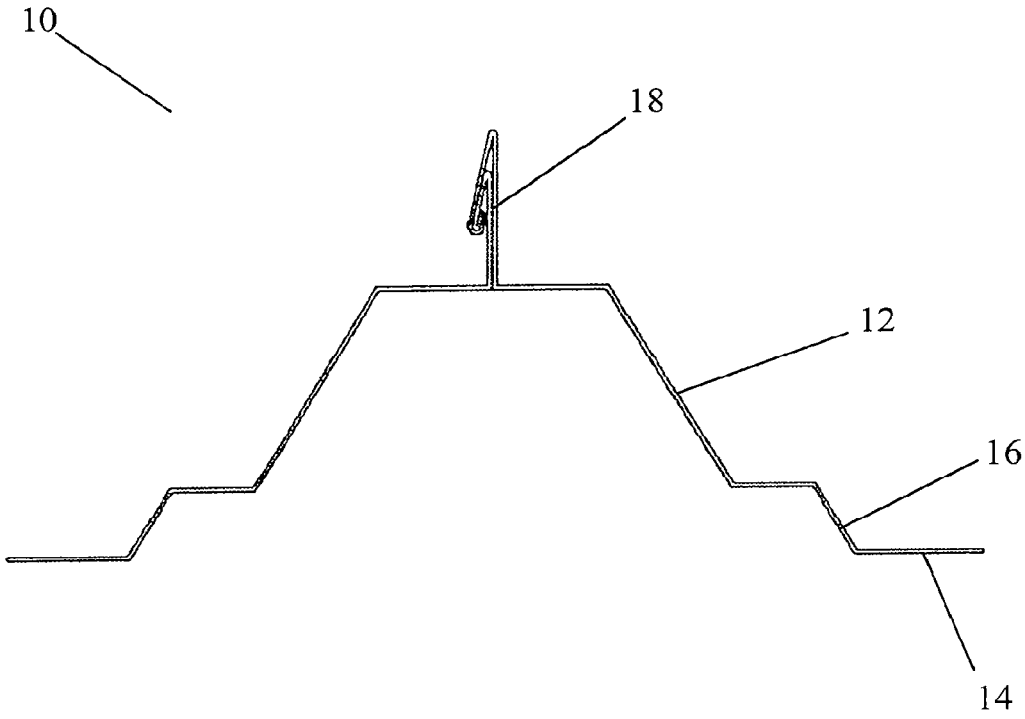
FIG. 1 is a view showing the roof profile of a metal roof of the type known as the standing seam panel roof.

The present invention provides a rail mounting system for installing various roof penetrating structures in metal roofs. For purposes of simplicity, "roof penetrating structures" and "skylights" will be used interchangeably to mean various forms of roof structures installed for the passage of light and/or ventilation to the interior of a building through a penetration in the roof. In the case of roof ventilation, examples include simple ventilation systems, such as roof fans and smoke vents, which are used to allow the escape of smoke through the roof during fires.

The number of skylights can vary from one to many structures connected end-to-end, be it only one to as many skylights as the building roof structure will support, limited only by the amount of support provided by the roof surface structure, which is left largely intact during the installation process.

The system utilizes the major rib structure in the roof as the primary support structure and water barrier to fasten the skylight assembly. Typical skylight installations do not allow for continuous runs, but use a curb construction that is typically 2-3 times wider than the skylight and rail mounting system of the present invention.

The rail mounting system of the invention does not require a complex structure underneath the panels or a separate curb construction to support or attach the skylight. The rail mounting system is attached directly to the rib elevations of the metal roof panels and allows for thermal expansion and contraction by utilizing the rib elevations of the metal roof panels for support.

In reference now to the figures, in which like reference characters indicate like parts throughout the several views, the system allows the installation of two or more adjacent skylights in an end to end fashion along the major rib structure of a building's metal roof panel profile.

Figure 2:
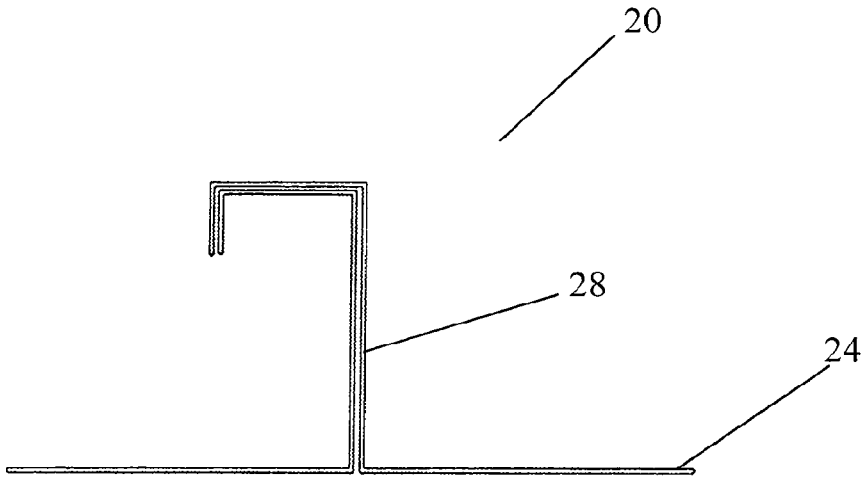
FIG. 2 is a view showing the roof profile of a metal roof of the type known as an architectural standing seam panel roof

The skylight system may be applied to various types of ribbed roof profiles. FIG. 1 is a view showing the roof profile of a metal roof of the type known as a standing seam roof panel 10. These include the "standing seam" roof, which has trapezoidal major rib elevations 12 typically 24" to 30" on center. Each panel 10 will also include the panel flat 14 having a shoulder 16 and a folded over standing seam 18 which seams one panel to an adjacent panel to prevent water from penetrating the roof FIG. 2 is a view showing the roof profile of a metal roof of the type known as an architectural standing seam roof, which is produced by a series of overlapping architectural standing seam panels 20. Each panel 20 comprises a panel flat 24, with an architectural standing seam 28 formed along the edges of the interconnecting panels, which presents a rib elevation type of structure. (As used herein, "rib elevation" shall mean any major structural elevation in the panel roofing system.)

Figure 3:
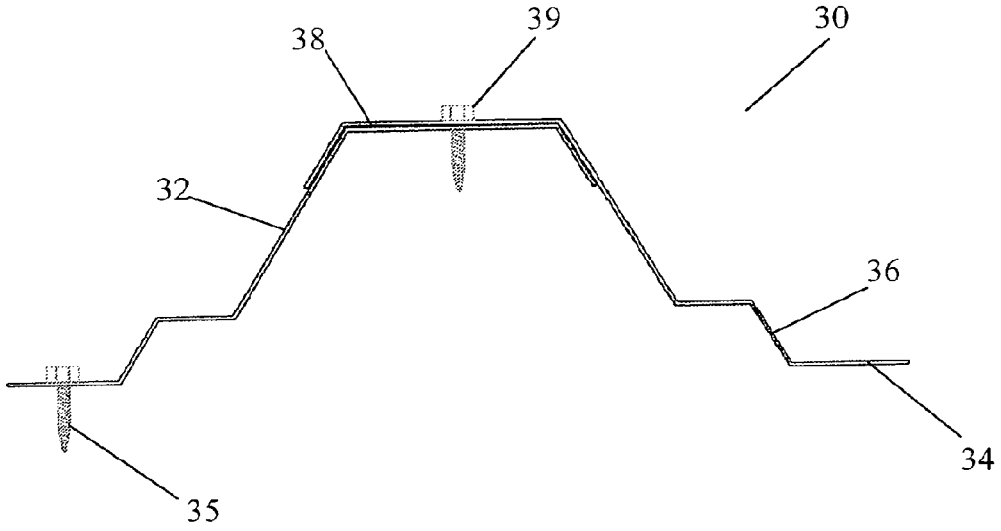
FIG. 3 is a view showing the roof profile of a metal roof of the type commonly referred to as an exposed fastener panel roof

FIG. 3 is a view showing the roof profile of a metal roof of the type commonly referred to as an R-panel or exposed fastener panel 30, with each panel having a rib elevation 32 and a panel flat 34. Adjacent R-panels are secured to the roof through the use of a structural fastener 35, and at the shoulder 36 which is formed from overlapping regions, or side lap 38. The adjacent panels are secured through the use of a stitch fastener 39. The trapezoidal major rib elevations of the R-panel roof are most typically formed at 8" to 12" on center.

Figure 4:
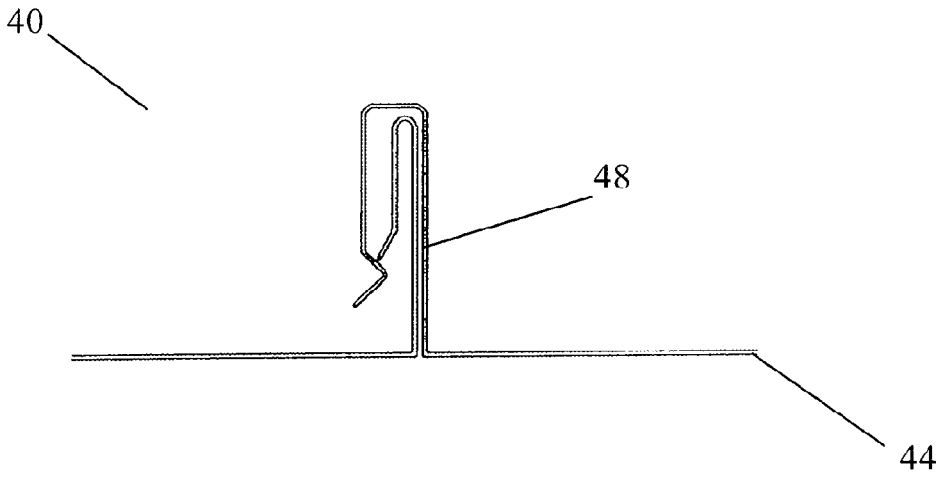
FIG. 4 is a view showing the roof profile of a metal roof of the type commonly referred to as a snap seam panel roof

FIG. 4 is a view showing the roof profile of a metal roof of the type commonly referred to as a snap rib seam panel 40. Snap seam panels 40 have a panel flat 44 and a standing seam or snap seam 48 at and along the edges of adjacent panels. Again, the snap seam provides a major structural elevation akin to a rib elevation.

Figure 5:
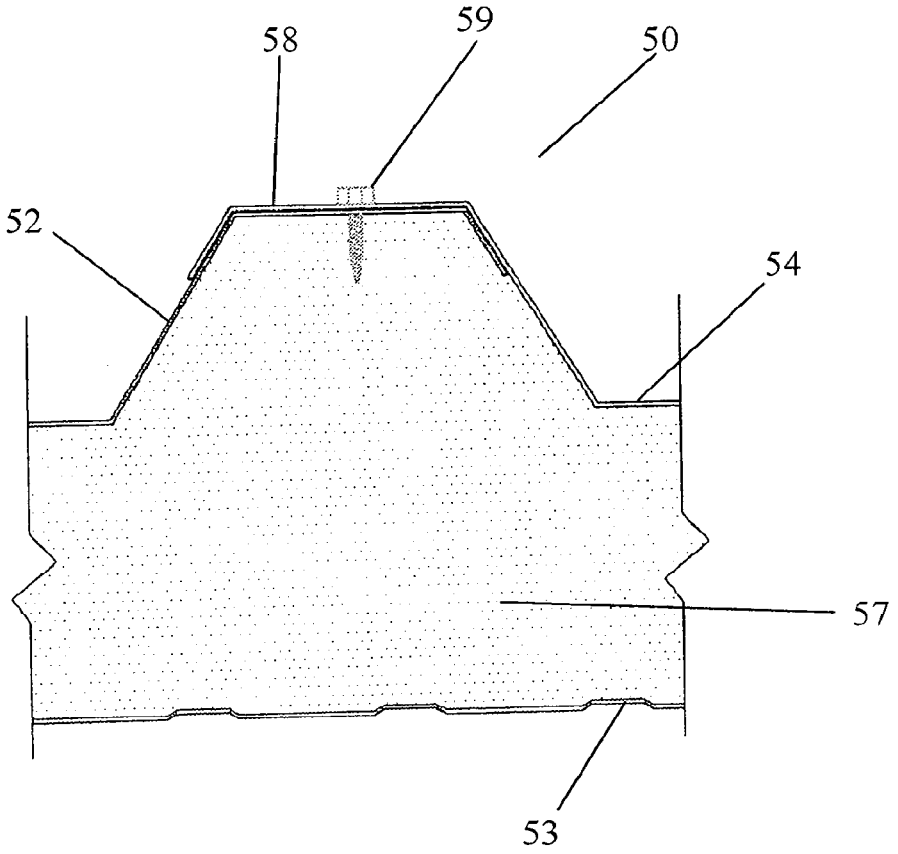
FIG. 5 is a view showing the roof profile of a metal roof of the type commonly known as foam core panel roof

FIG. 5 is a view showing the roof profile of a metal roof of the type commonly known as foam core panel 50, which has a rib elevation 52, a liner panel 53, a panel flat 54 and a foam core 57. Side laps 58 are secured by a stitch fastener 59. This panel is typically installed from the interior of the building.

The rail mounting system supports skylights on the major structural elevations of the metal panel roof, which include seams, rib structures, or other elongated raised structural elements. The raised structural elements or rib elevations provide the structural support for the skylights over an opening or penetration formed in the intervening, non-structural flat region of the roof panels.

Figure 6:
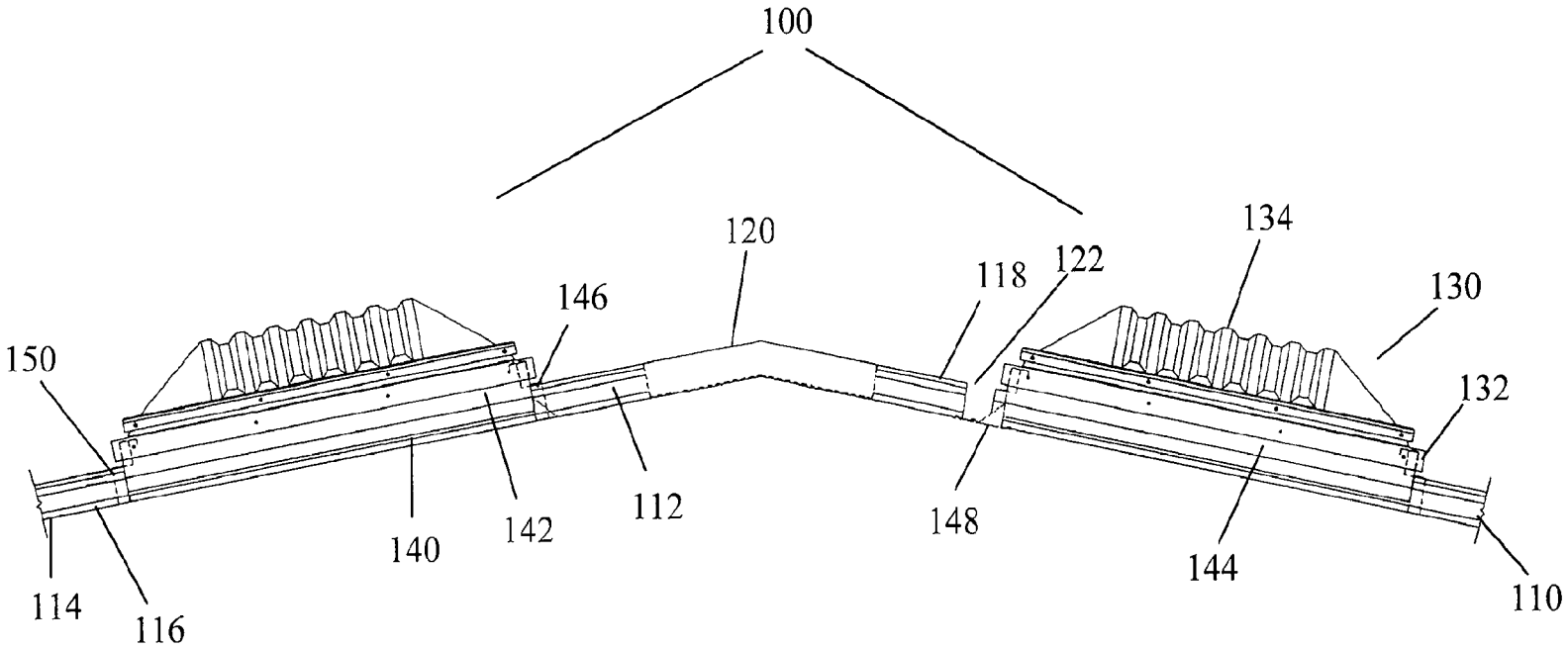
FIG. 6 is a side elevational view of two skylights installed on a metal roof using a rail mounting system in accordance with the invention.
Figure 7:
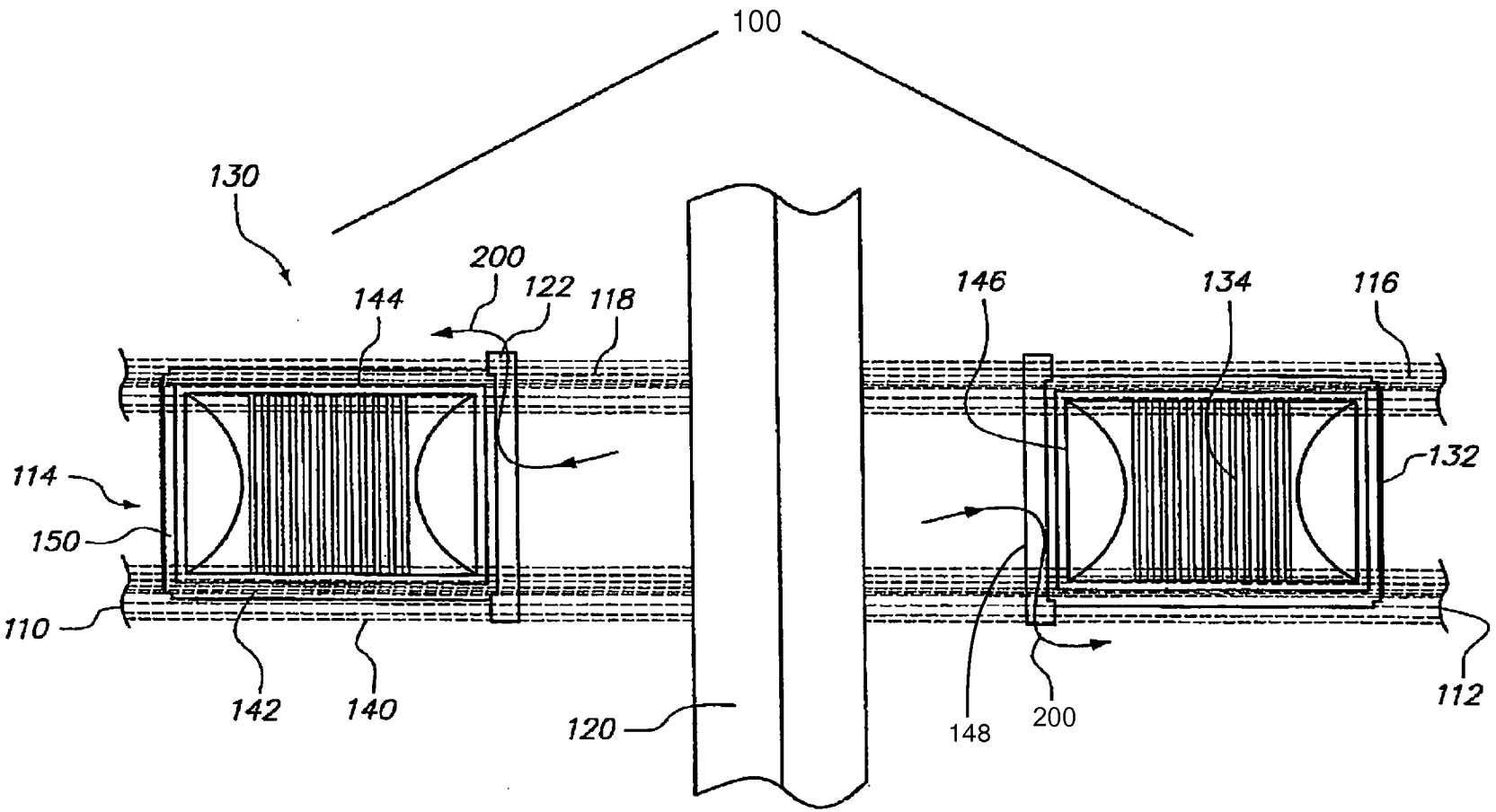
FIG. 7 is a top plan view of the skylights of FIG. 6, showing the placement of skylights and the direction of water flow over the roof

Turning now to FIGS. 6 and 7, there is shown an exemplary skylight and rail mounting system 100 adapted for attachment to a standing seam panel roof 110. While the figures depict the skylight and rail mounting system mounted to a standing seam metal panel roof, it will be understood that the rail mounting system components could easily be adapted, by suitably shaping its components, for attachments to the major structural elevations any roof system where the structural elevations have different characteristic profiles.

Referring again to the figures, and particularly FIGS. 6 and 7, the standing seam metal panel roof 110 is seen to have raised rib or rib elevations 112 and a panel flat 114 extending between the rib elevations. Each rib elevation includes a raised shoulder 116 and standing seam 118. Also depicted is the ridge cap 120 of the metal panel roof.

The skylight and rail mounting system 100 includes a skylight 130, which is comprised a skylight frame 132 and skylight lens 134. While the figures depict a skylight, it will be understood that the rail mounting system, denoted by numeral 140, of the skylight and rail mounting system 100 also could be adapted for use with any number of roof penetrating structures, from various types of skylights to smoke vents or other ventilating structures.

The rail mounting system 140 is comprised of side rails 142 and 144, which are further described below. These side rails will prevent water intrusion through the sides of the skylight and rail mounting system 100. In order to prevent water intrusion at the top of the skylight and rail mounting system, an upper diverter 146 is disposed between and adjacent rib elevations 112 of the metal panel roof 110 at the top ends of the side rails 142, 144. A rib cutaway region, or gap 122, in one of the rib elevations 112 is provided the top end of the side rails so that water that collects at the top of the skylight and rail mounting system can be diverted by diverter 146 onto an adjacent roof panel. A plate 148 may be located under the gap 122 to prevent water leakage through the roof. When installing the side rails and upper diverter to a roof, the plate 148 may be sealed and fastened securely to the roof panel supports.

FIG. 7 shows how the gap 122 in one of the roof rib elevations 112 allows water flow 200 to occur along the roof surface, over plate 148, and down and away from the roof ridge cap 120.

A low end closure 150 may be provided between the rib elevations 112 at the bottom ends of side rails 142, 144 to prevent water intrusion at this end of the skylight and rail mounting system 100.

Figure 8:
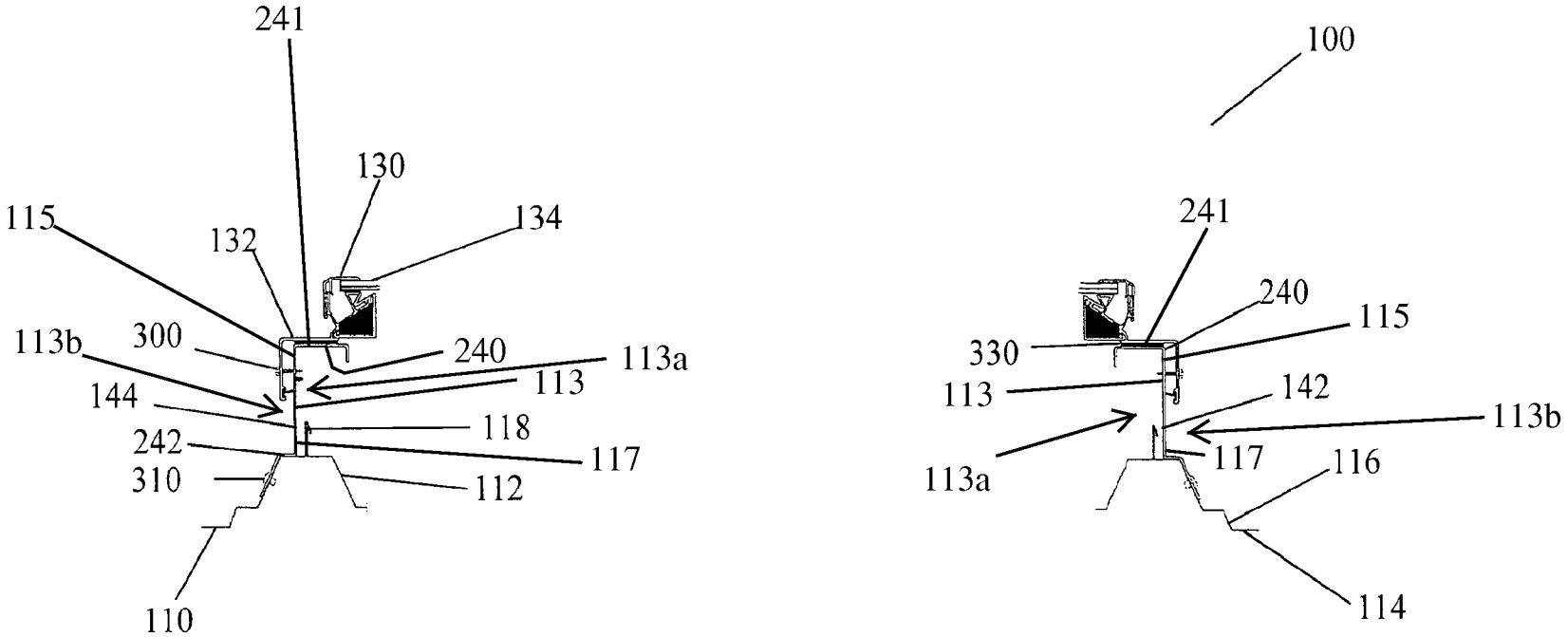
FIG. 8 is a fragmentary cross sectional view of metal roof and one of the skylights shown in FIGS. 6 and 7, showing the adjacent rib elevations of the metal roof, the side rails of the rail mounting system attached to the outside of the rib elevations relative to the skylight, and the side edges of the skylight supporting on the side rails.

Referring now to FIG. 8, there is shown a cross section of the skylight 130 and rail mounting system 140, showing the securement of the side rails 142, 144 of the rail mounting system to the standing seam panel roof 110. In particular, FIG. 8 depicts the use of the rib elevation 112 to support the side rails 142, 144. It is seen that each side rail 142, 144 has a vertical riser portion, suitably a riser wall 113, having a first side 113*a* and second side 113*b*. An upper flange 240, which provides a top and suitably horizontal bearing surface 241, extends laterally from the first side 113*a* of the riser wall and most suitably from its top end 115. A bottom shoulder structure 242 extends laterally from the second side 113*b* of the riser wall, most suitably from its bottom end 117. The side rails 142 and 144 are secured to the skylight frame 132 by a fastener 300. The side rail's bottom shoulder structure 242 is shaped to fit closely over the outside of the roof rib 112, and can be secured to roof rib 112 by a rivet 310. The rail bearing surface 240, which suitably can be a horizontal surface, supports the skylight frame 132, and a sealant 330 (see FIG. 9) can be applied to this surface to seal against the passage of water or air.

Figure 9:
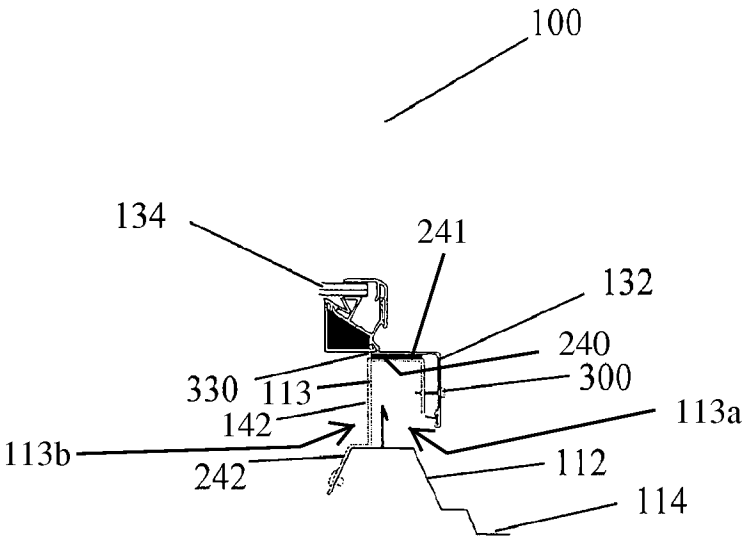
FIG. 9 is a cross sectional view showing an alternative arrangement for the rail mounting system shown in FIG. 8, wherein the side rails are mounted to the inside of the rib elevations relative to the skylight.
Figure 9:
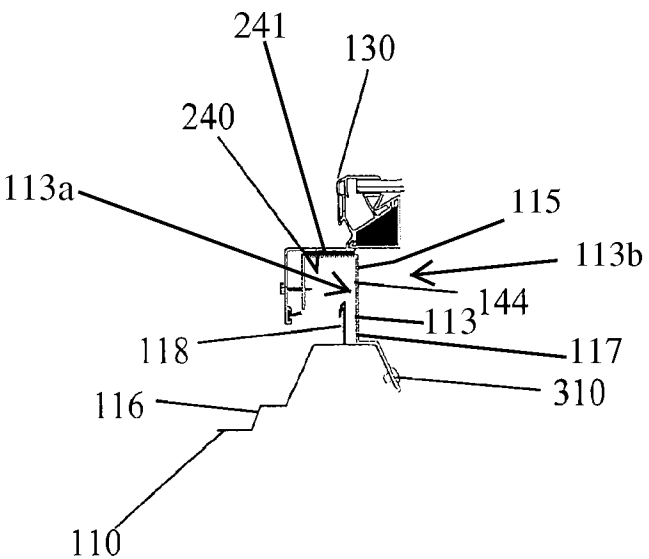

FIG. 9 depicts a variation of the rail mounting system 140 shown in FIG. 8, where the side rail's bottom shoulder structure 242 is shaped to fit closely along the inside instead of the outside of the rib evelavations 112, and is secured to the inside of the rib elevations by a rivet 310. As for FIG. 9, the rail bearing surface 240 similarly supports the skylight frame 132, where the sealant 330 can be applied.

It can be seen that the bottom shoulder structures of the side rails 142, 144 of the rail mounting system 140 can be shaped to fit closely along the contour of the rib elevations 112 of panel roof 110. The various mating surfaces of the side rails 142, 144 and the rib elevations 112 can be sealed in various ways known to the roofing art, including caulking or tape mastic, or various rubber fittings or inserts can be used to seal the open area of the panel roof.

Figure 10:
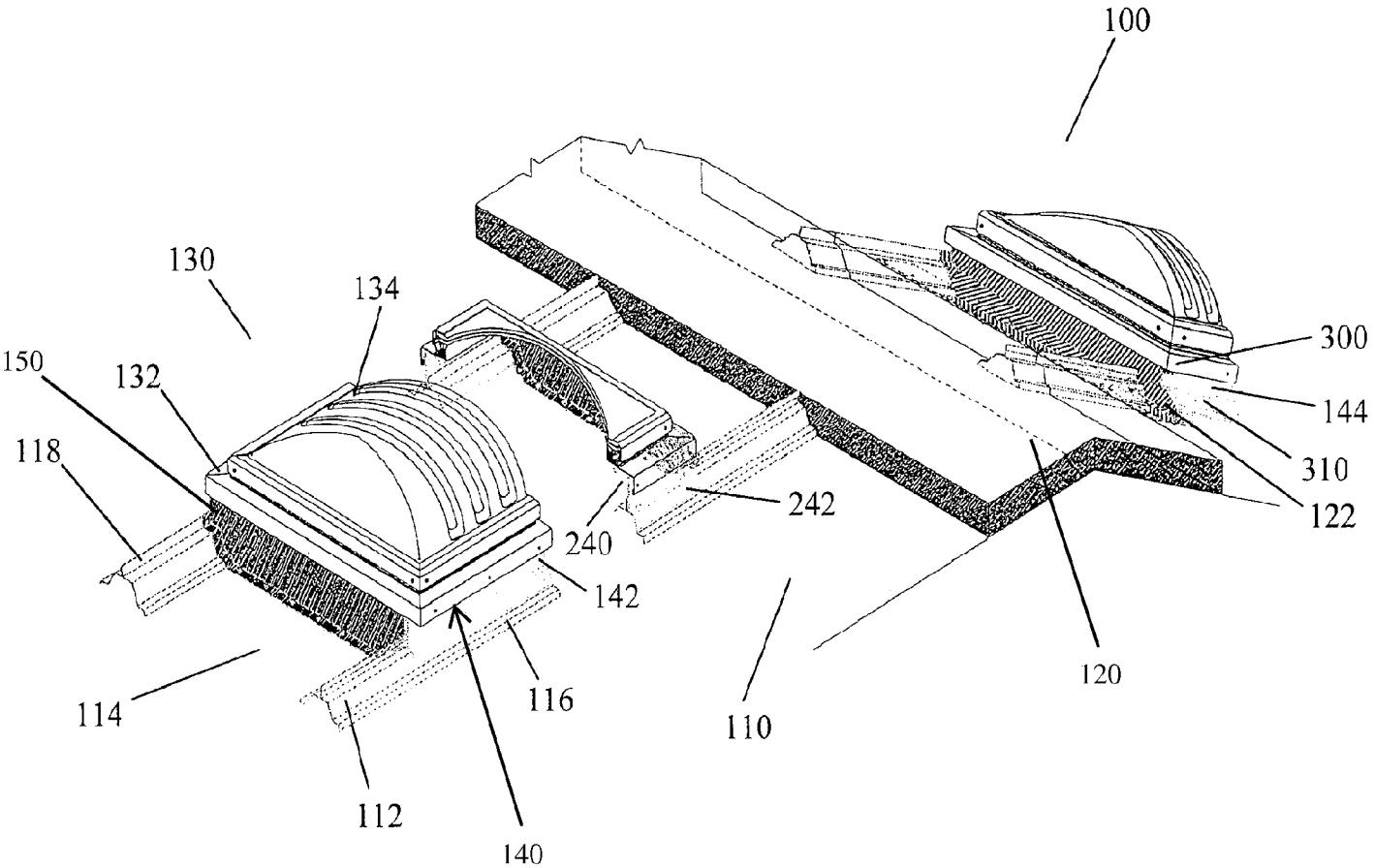
FIG. 10 is a perspective and partially cut away view of the skylights, metal roof and the rail mounting system shown in FIGS. 6 and 7.

In FIG. 10, a partially cut away perspective view of the skylight and rail mounting system 100 is used to show the support of the rail mounting system by the standing seam panel roof 110, and particularly by the elevated rib 112 which provides the structural support for the skylight 130. In FIG. 10, it is generally seen how the rail mounting system 140 incorporates the structural profile of the rib elevations of metal roofs and how the rib elevations and side rails are used to prevent water intrusion from adjacent panels.

Most standing seam roofs are seamed using various clip assemblies that allow the roof to float, along the major elevation. Typically, the roof is fixed at the eave and allowed to expand and contract over at the top ridge. Very wide roofs can be fixed at mid-span and expand towards both the eave and ridge. The design of the skylight and rail mounting system 100 takes full advantage of the floating features of contemporary roofing structures, and when a skylight 130 is secured to the rib elevations by the side rails 142, 144 of the rail mounting system, the skylights are able to draw strength from the structural load bearing capacity of the profile of the roof's rib elevations.

Shown in FIG. 10 is the panel flat 114, rib elevation 112 and shoulder 116, as well as the standing seam 118. The ridge cap 120 is also shown, as well as the gap in the roof 122. The skylight 130 is supported on the side rail 142, 144 of the rail mounting system 100, as previously described.

In FIG. 10, the skylight frame 132 is fastened to the side rails 142, 144 of the rail mounting system by a series of fasteners 300; the side rails are in turn fastened to the rib elevations 112 by a series of rivets 310.

In application, a single rib elevation 112 is typically cut away (gap 122) at the top of the skylight 130 to accommodate drainage at the high end of the skylight or run of skylights (toward ridge cap 120) where the high end diverter 146 is located. This is an important feature for standing seam, architectural standing seam and snap seam roofs. Two ribs may be cut for roofs having an R-panel profile.

The rib elevations 112 serve as a beam to support the side rails 142 and 144 and maintain a watertight seal along the length of the assembly. Internal portions of the ribs elevations 112 may be removed to allow additional light from the skylight 130.

A single bearing plate structure 148 is used for sealing the cut away rib. The bearing plate 148 also provides some support to link adjacent rib elevations 112, and is typically produced of steel or other material sufficient to provide a rigid substructure for the skylight.

The side rails 142, 144 of the rail mounting system 140 are shaped in such a manner that the skylight can be easily fastened directly to the side rails with rivets or fasteners such as screws and the like. The side rails may also be designed to accept a safety security guard before the skylight is installed.

Figure 11:
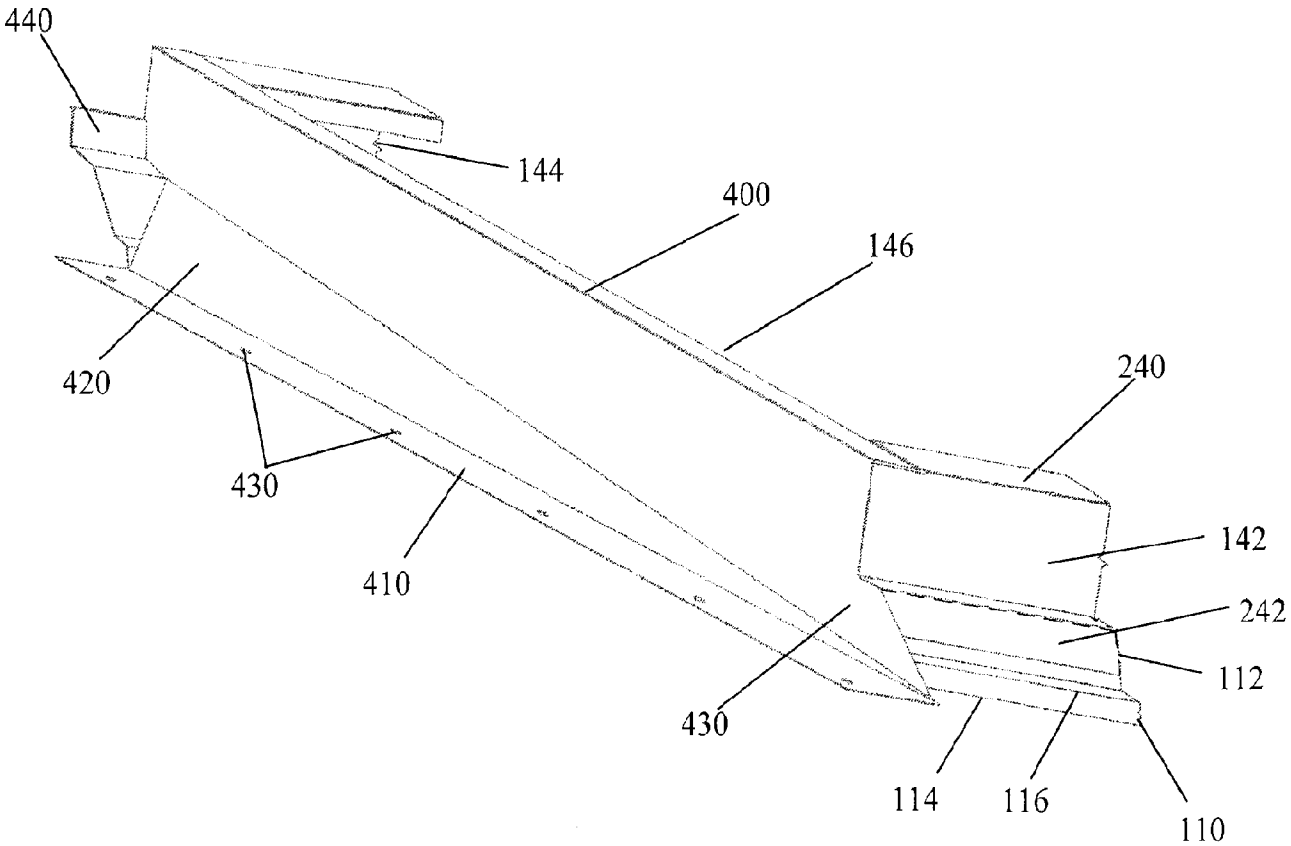
FIG. 11 is a top perspective view of the upper rain pan or diverter used in the skylight installation shown in FIGS. 6 and 7.
Figure 12:
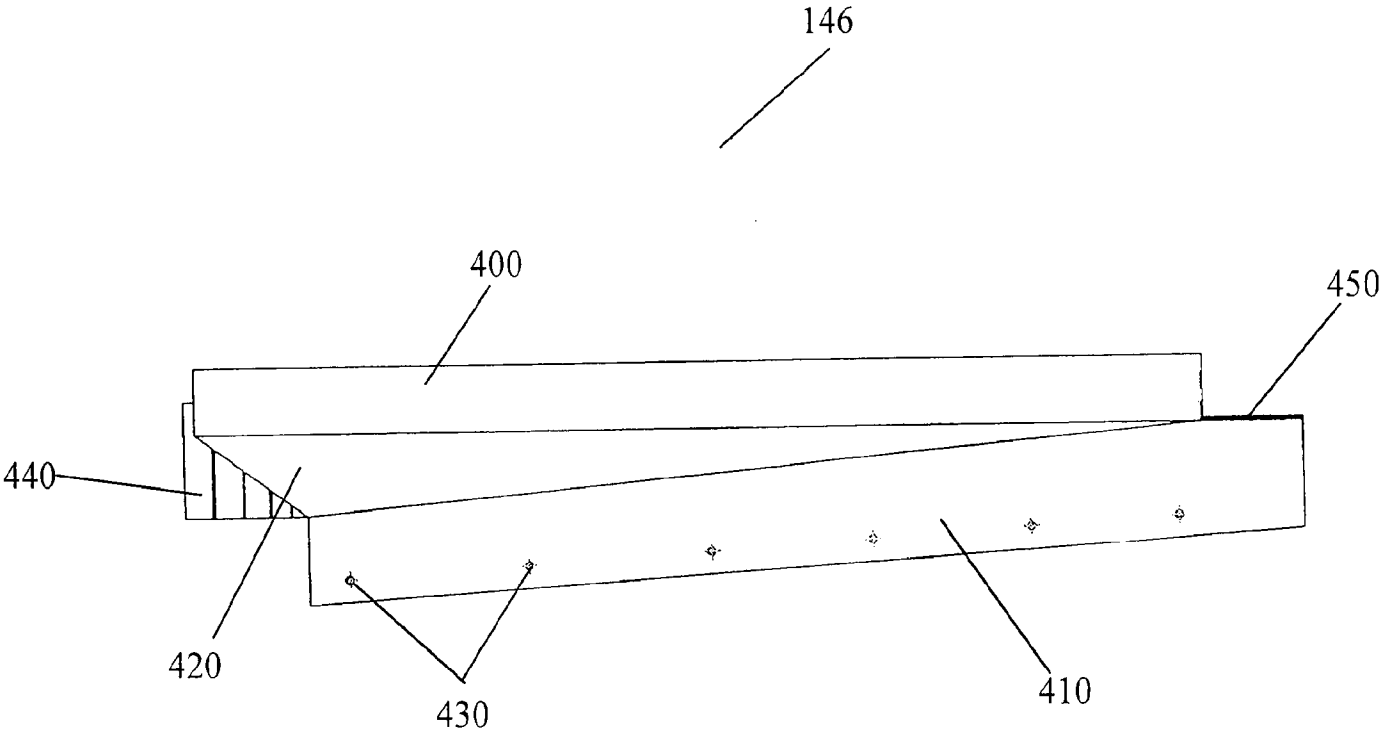
FIG. 12 is a top plan view of the diverter of FIG. 11.
Figure 13:
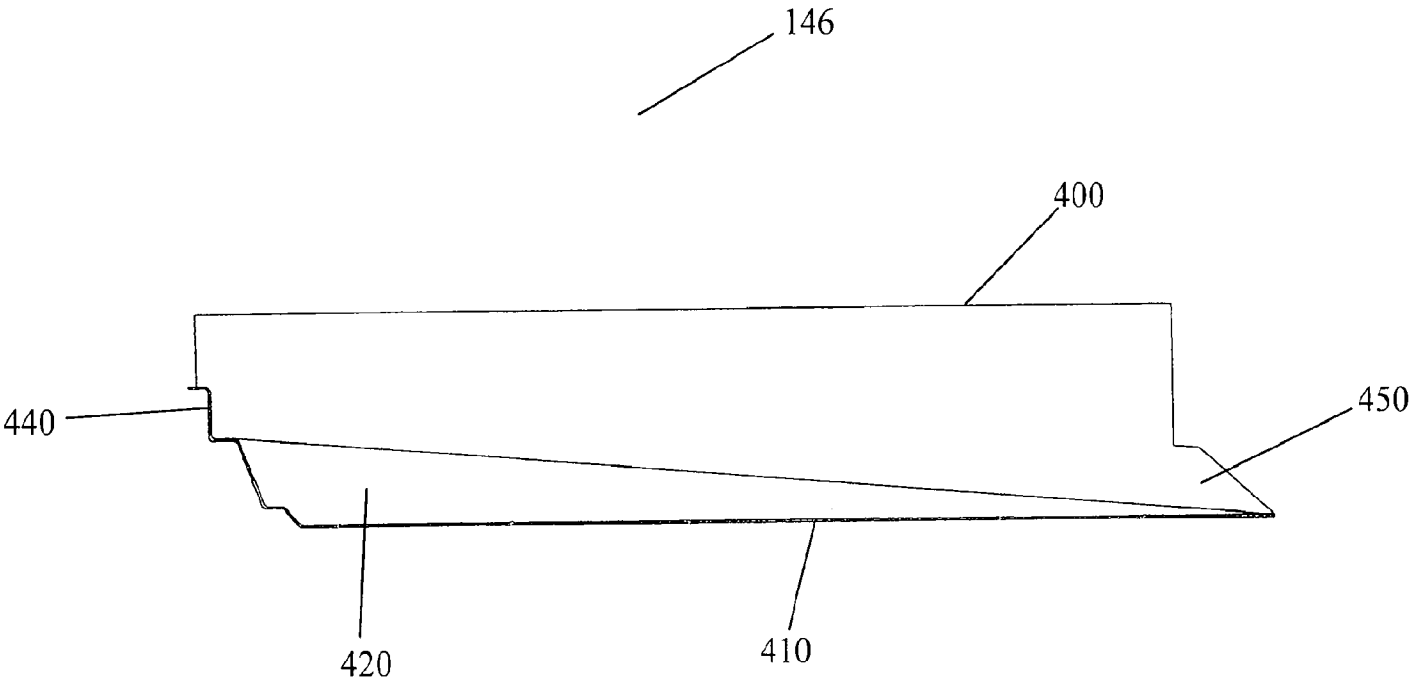
FIG. 13 is a front elevational view of the diverter of FIG. 11.

Referring now to FIGS. 11 through 13, an upper or high end diverter 146 provides closure at the top of the skylight and rail mounting system and diversion of water to an adjacent panel flat. Diverter 146 also provides a weather tight seal at the upper end of the skylight. In reference to the rib elevations 112 of the standing seam panel roof 110, the diverter 146 generally fits the profile of the rib at the region of the cut away gap 122. The diverter 146 abuts side rails 142 and 144 and the height of the diverter closely matches the height of the side rails. The upper flange 400 of the diverter 146 acts with upper flanges 240 of the side rails 142 and 144 to form the bearing surface of the skylight frame.

The lower flange 410 of diverter 146 runs along the panel flat 114. The diverter 146 also has a diversion surface 420 and fastener holes 430 along its lower flange. At one end of the diverter is a rib mating surface 440 and at the other end there is formed a rib sealing plate 450.

Figure 14:
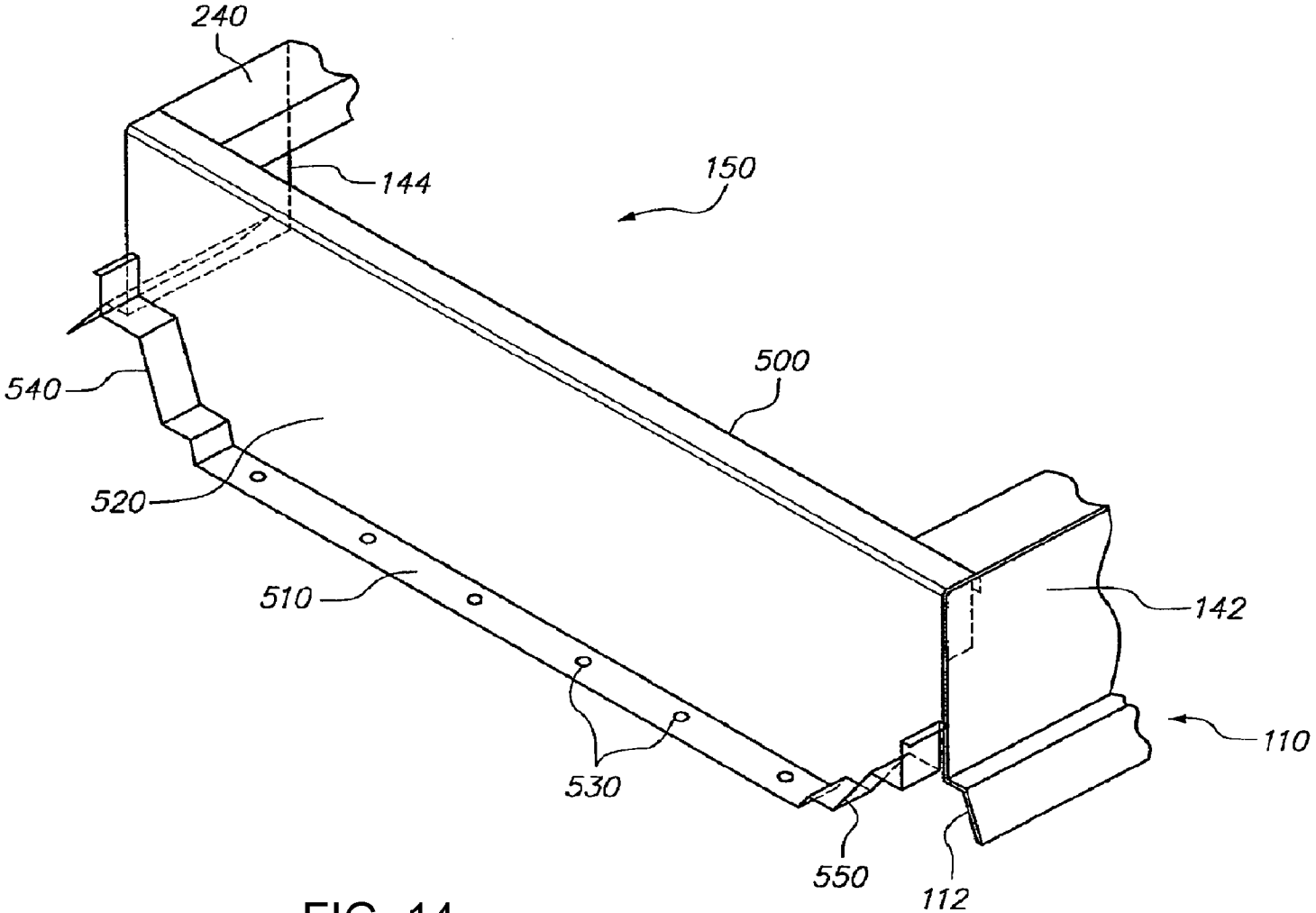
FIG. 14 is a top perspective view of the low end rain pan or closure used in the skylight installation shown in FIGS. 6 and 7.
Figure 15:
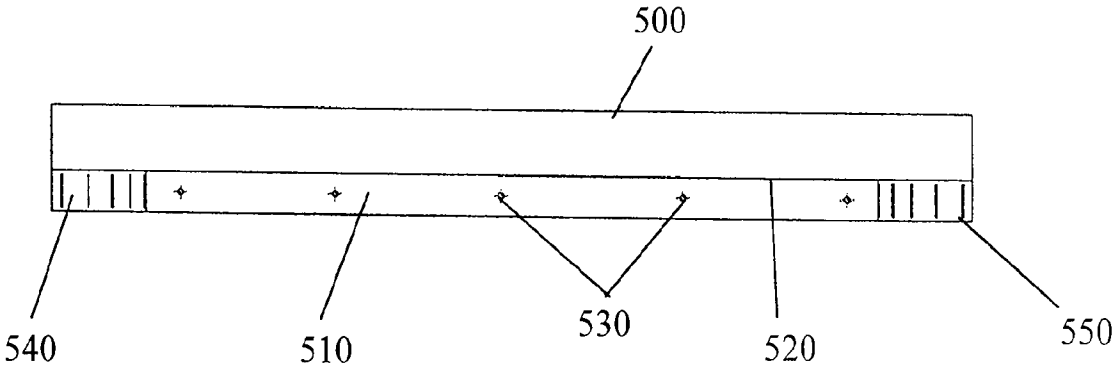
FIG. 15 is a top plan view of the low end closure of FIG. 14.
Figure 16:
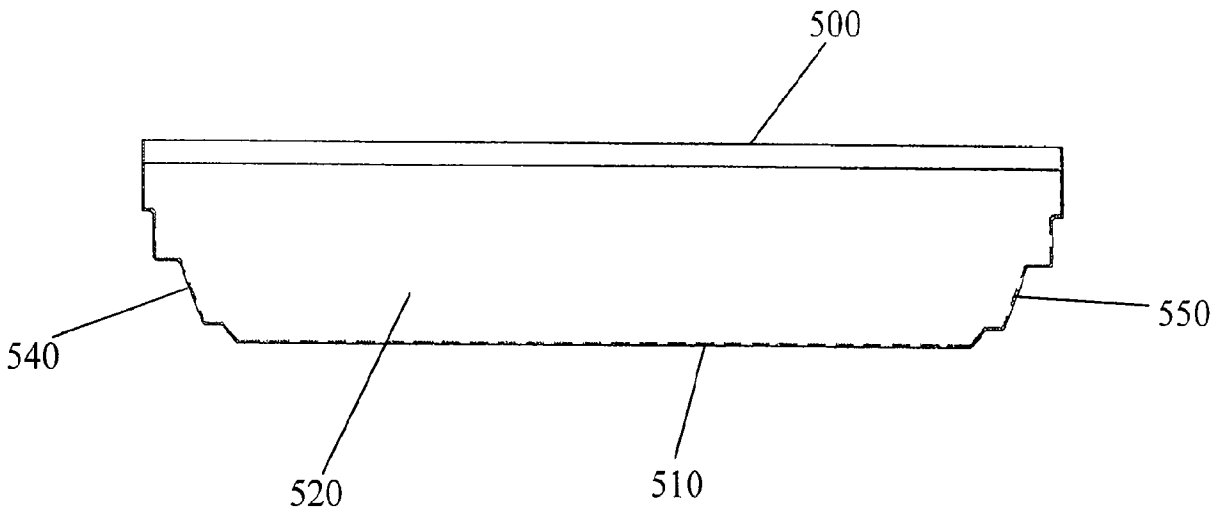
FIG. 16 is a front elevational view of the low end closure of FIG. 14.

FIGS. 14 through 16 show the low end closure 150 that is used to maintain a weather tight seal at the lower end of the skylight and rail mounting system 100. The closure 150 is adapted to fit the profile of the rib elevations 112. The ends of the closure 150 abut the side rails 142, 144, and the height of the closure 150 matches the height of the side rails.

Looking to the closure 150, it is seen to have an upper flange 500 and a lower flange 510, as well as a closure web 520. The lower flange 510 includes fastener holes 530.

The low end closure 150 also includes rib mating surfaces 540 and 550 to provide a tight fit along the ribs 112.

Figure 17:
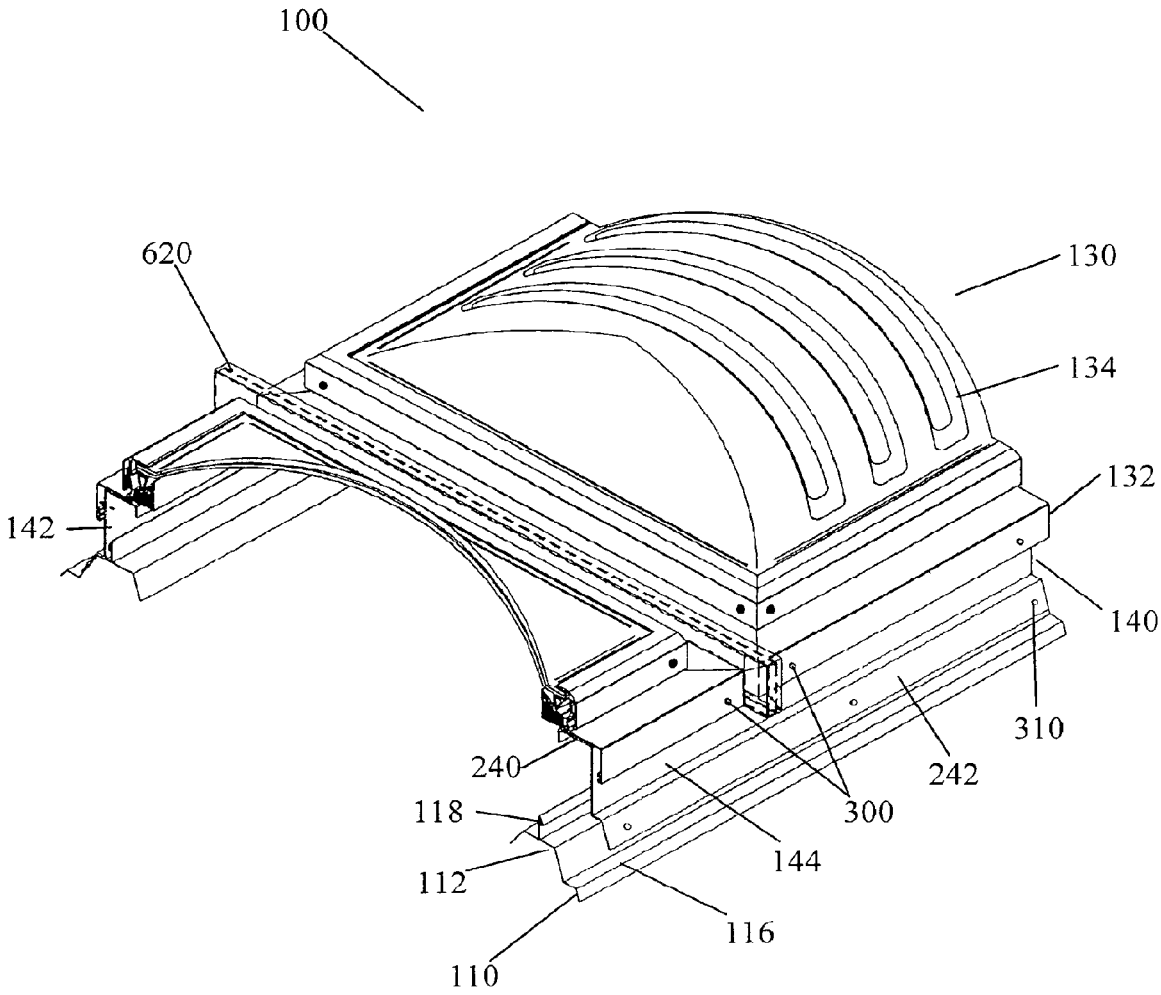
FIG. 17 is a top perspective and partially cut away view of two skylight units installed on the rib elevations of a metal panel roof using a rail mounting system in accordance with the invention, and showing the skylight units joined together to form a run of skylights.
Figure 18:
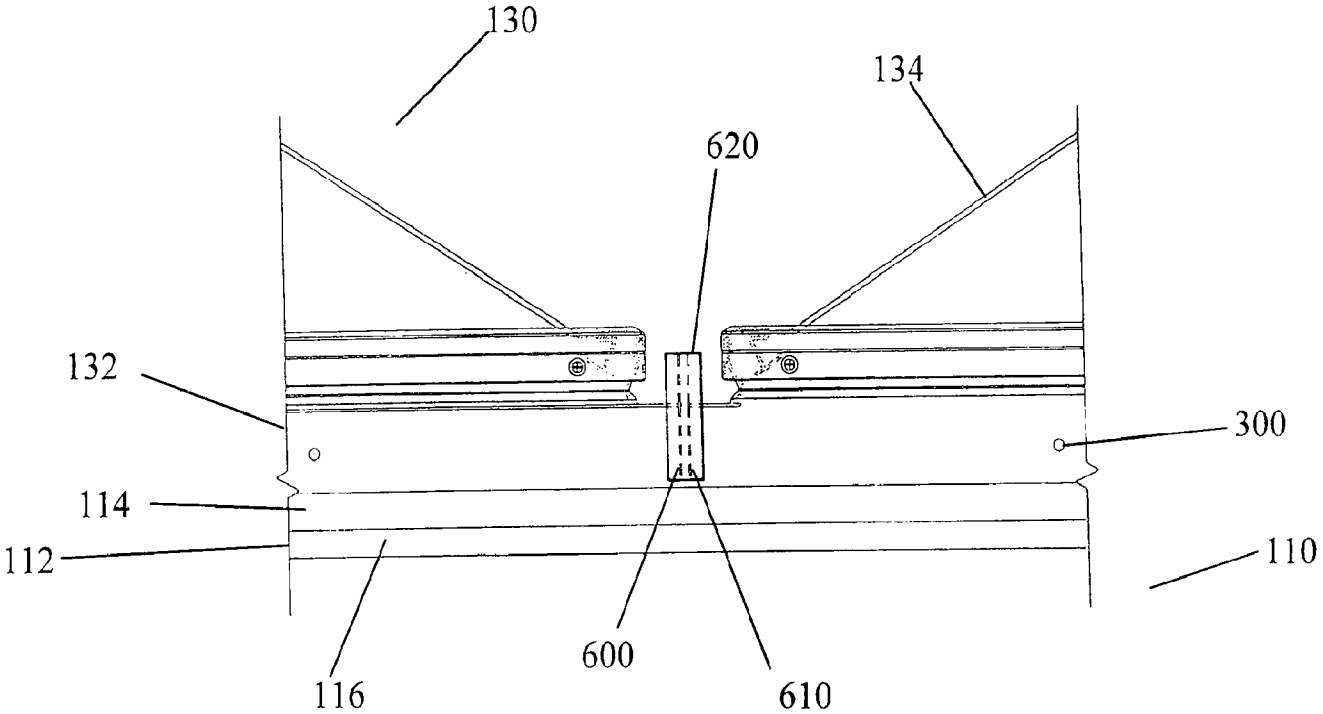
FIG. 18 is a cut-away partial side elevational view of the two skylights, the metal roof and side rails of the rail mounting system shown in FIG. 17, showing in greater detail the batten structure for connecting the two skylights.

Referring now to FIGS. 17 and 18, the adaptation of the system for the application of multiple roof penetrating structures, in this case skylight 130, is described. A chief aspect of the skylight and rail mounting system 100 is the reduction in the number of roof penetrations required to provide daylight to the interior of a structure, as fewer, longer cuts can be made along the roof panels. These minimized openings can be maintained along a single roof panel, if desired, with one continuous opening versus many smaller ones permitting an equal or greater amount of ambient light into the building.

In the case of standing seam roofs the system provides the ability to remove only a portion of the bottom flat of the panel. This maintains the structural integrity of the roof in that multiple sections of major panel elevations are not removed, as is done to accommodate a "typical" curb assembly. There are fewer potential areas for water infiltration in that the skylight panels can be attached very near the ridge of the building and run to the eave requiring water to be diverted only once near the ridge of the roof plane and only across one panel flat.

To the limited extent that cutaways are made to the rib elevations, these are made small, on the order of a few inches or less, solely for the purpose of allowing drainage past the skylights.

The rail system is designed to install to either the inside or outside of the major rib elevation for any of the aforementioned roof panel profiles.

The rail mounting system 140 is particularly useful for continuous runs of skylights end to end. FIGS. 17 and 18 show how two adjacent skylights can be mounted to a standing seam panel roof 110 using a skylight and the rail and mounting system in accordance with the invention. Instead of using upper end diverters and lower end closures, where adjacent skylights abut, the rail mounting system 140 is provided with upper and lower standing rib frames 600 and 610 at adjacent ends of the skylights. A batten 620 is provided to secure the system 100 against the elements. FIG. 18 is a side elevational view of the batten 620, showing how it fits over the adjacent upper and lower standing rib frames 600 and 610.

As only one example, skylights can be produced in units of up to 10 feet long, and connected in this fashion for as long as necessary, as each skylight unit is supported by the primary rib elevations of the panel roof. The standing rib elevations run longitudinally along the length of the side rails of the skylight and rail mounting system, whether one or a number of back-back skylights are used. No water can enter over the top of the side rails of the rail mounting system or enter the top end or bottom end of skylight run.

Where it is desired that the skylight starts at the ridge of the roof, a simple flashing can be inserted under the ridge cap.

Where the ridge cap has a configuration to fit the rib elevations (major corrugations) in the roofing panels, a portion of one rib may be cut out (approximately 2"), allowing the water from the roof panel above to be diverted on to the next panel.

If desired, a simple rail enclosure extension could be used to increase the height or distance between the skylight frame and the roof panel, and can be adapted to simply lie over or attach to the top of the rail mounting system. Such an extension could be produced to rest along the upper flange of the rail mounting system to effectively raise the height of the skylight or smoke vent to accommodate different skylight depths or other design features, or to accommodate snow conditions and the like. In this fashion, the rail mounting system can be produced to a standard height, with varying extensions used to elevate the overall height of the structure for such varied purposes. Various forms for such an extension would be suitable, and the skilled artisan will understand various ways and means of designing and manufacturing these to accomplish the goal of added height to the skylight.

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of this invention.

We claim:

1. A metal panel roofing system, comprising:

at least one roof eave, a roof ridge, roofing panels extending from the at least one roof eave to the roof ridge, said roofing panels forming a roof having rib elevations extending in parallel relation from the roof eaves toward the roof ridge and panel flats between said rib elevations, a roof penetration in at least one panel flat of the roof between two of the rib elevations, a skylight or other structure mounted to said side rails over said roof penetration, and side rails mounted directly to the rib elevations adjacent said roof penetration, wherein the side rails extend in the direction of said rib elevations and engage said rib elevations over substantially the entire length of the side rails, and wherein the rib elevations provide structural support for the side rails over substantially the entire length of the side rails, wherein each side rail has a length and is comprised of:

a vertical riser portion, an upper flange extending from said vertical riser portion and providing a top bearing surface for supporting one side of said skylight or other structure, and a bottom shoulder structure for engaging the rib elevations of the roof adjacent said roof penetration over the length of the side rail such that the riser portion of the side rail extends upwardly from the rib elevation over the length of the side rail.

2. The roofing system of claim 1 wherein the rib elevations of the roofing system have a cross-sectional profile, and wherein the bottom shoulder structure of each side rail is shaped to mate with the rib elevation to which it is attached over at least a portion of the cross-sectional profile of the rib elevation to which the side rail is attached.

3. The roofing system of claim 2 wherein said rib elevations have an outside facing away from the roof penetration and an inside facing toward said roof penetration, and wherein the bottom shoulder structure of each side rail is attached to and mates with the outside of the rib elevations.

4. The roofing system of claim 1 wherein said rib elevations have an outside facing away from the roof penetration and an inside facing toward said roof penetration, and wherein the bottom shoulder structure of each side rail is attached to and mates with the inside of the rib elevations.

5. The roofing system of claim 1 wherein the roofing system is a standing seam metal panel roofing system, and wherein the bottom shoulder structure of each side rail is attached to and mates with only one side of the rib elevations.

6. The roofing system of claim 1 wherein the vertical riser portion of each of said side rails has a top end and a bottom end and wherein said bottom shoulder structure extends from the bottom end of the riser portion.

7. The roofing system of claim 1 wherein said vertical riser portion has a top end and a bottom end and wherein said upper flange extends from the top end of the riser portion.

8. The roofing system of claim 1 wherein said vertical riser portion has a first side and a second side, and wherein the upper flange extends laterally from the first side of said riser portion and the lower shoulder structure extends laterally from the second side of said riser portion.

9. The roofing system of claim 1 wherein the riser portion of each said rails is in the form of a substantially continuous riser wall extending along the top of the rib elevation.

* * * * *